US006875123B2

(12) United States Patent
Wilson

(10) Patent No.: US 6,875,123 B2
(45) Date of Patent: Apr. 5, 2005

(54) ADJUSTABLE GOLF CLUB

(75) Inventor: Geoffery Wilson, Fulwood (GB)

(73) Assignee: Tidymake Limited (GB)

( * ) Notice: Subject to any disclaimer, the term of this patent is extended or adjusted under 35 U.S.C. 154(b) by 204 days.

(21) Appl. No.: 10/077,316

(22) Filed: Feb. 15, 2002

(65) Prior Publication Data

US 2002/0111227 A1 Aug. 15, 2002

(30) Foreign Application Priority Data

Feb. 15, 2001 (GB) ..... 0103671

(51) Int. Cl.[7] ..... A63B 53/16
(52) U.S. Cl. ..... 473/239; 473/296
(58) Field of Search ..... 473/296, 239; 280/819; 43/18.1; 403/109.3, 109.5, 109.8, 109.4, 109.7

(56) References Cited

U.S. PATENT DOCUMENTS 3,539,185 A * 11/1970 Andis ..... 473/296
5,976,030 A 11/1999 Hsieh ..... 473/296

FOREIGN PATENT DOCUMENTS

| | | |
|---|---|---|
| GB | 472040 | 9/1937 |
| GB | 2309389 | 7/1997 |
| GB | 2331464 | 5/1999 |
| JP | 9201435 | 8/1997 |

* cited by examiner

*Primary Examiner*—Stephen Blau
(74) *Attorney, Agent, or Firm*—Madson & Metcalf

(57) ABSTRACT

A golf club which includes an adjustable shaft, in which the shaft comprises an inner shaft part, an outer shaft part which receives an end of the inner shaft within it in a telescoping arrangement, and an internal tube which is fastened within the outer shaft part and which extends along the inside of the outer shaft to engage the inner shaft part in a telescoping arrangement. One of the internal tube and the inner shaft part is split at its end. The club includes a locking mechanism by which the inner shaft and the internal tube can be locked together against relative axial and rotational movement, comprising an expander which can be withdrawn into the split end to cause it to become splayed, to engage the internal surface of the other of the internal tube and the inner shaft part. The expander can be withdrawn into the split end to cause its end to become splayed by the action of a resiliently deformable spring, which biasses the expander towards the locking position.

29 Claims, 7 Drawing Sheets

ADJUSTABLE GOLF CLUB

BACKGROUND OF THE INVENTION

This invention relates to a golf club which includes an adjustable shaft.

Conventional golf clubs have a shaft whose length is fixed. Some clubs, especially putters, have a profiled grip to aid the user in aligning the club head. The alignment of the grip with the club head is fixed.

It would be desirable for the length or angular alignment or both of a club to be adjustable so that a club can be used comfortably by different players. Constructions of clubs have been proposed in which a shaft is made adjustable using upper and lower parts which fit together in a telescoping arrangement.

Adjustable parts of a golf club shaft should be firmly fixed together so that they will not work loose during play. Furthermore, it is preferred that telescoping shaft parts should fit together with few or no parts of the locking mechanism visible at the point where the shaft parts are connected, so that the shaft has the appearance of a conventional shaft whose configuration is fixed.

BRIEF SUMMARY OF THE INVENTION

The present invention provides an adjustable shaft for a golf club which includes inner and outer telescoping shaft parts, in which the shaft includes a locking mechanism by which the inner and outer shaft parts can be locked together against relative axial and rotational movement, comprising an expander which can be withdrawn into the split end of an inner tube part to cause it to become splayed, to engage the internal surface of an outer tube part.

Accordingly, in one aspect, the invention provides a golf club which includes an adjustable shaft, in which the shaft comprises:

a. an inner shaft part, b. an outer shaft part which receives an end of the inner shaft within it in a telescoping arrangement, and c. a locking mechanism by which the inner and outer shaft parts can be locked together against relative axial and rotational movement, in which the locking mechanism comprises an inner tube part which has a split end and an outer tube part which can receive the split end of the inner tube part in a telescoping arrangement, and an expander which can be drawn into the split end of the inner tube part to cause it to become splayed, to engage the internal surface of the outer tube part.

In another aspect, the invention provides a golf club which includes an adjustable shaft, in which the shaft comprises:

a. an inner shaft part, b. an outer shaft part which receives an end of the inner shaft within it in a telescoping arrangement, and c. an internal tube which is fastened within the outer shaft part and which extends along the inside of the outer shaft to engage the inner shaft part in a telescoping arrangement, in which one of the internal tube and the inner shaft part is split at its end, and in which the club includes a locking mechanism by which the inner shaft and the internal tube can be locked together against relative axial and rotational movement, comprising an expander which can be withdrawn into the split end to cause it to become splayed, to engage the internal surface of the other of the internal tube and the inner shaft part.

The club of the invention has the advantage that inner and outer telescoping shaft parts can be connected together so that the length of the club is fixed, and so that the angular alignment of the grip relative to the club head is fixed. Fixing the shaft parts in this way is achieved internally so that the shaft has the appearance of a shaft which is formed in one part. Fixing of the shaft parts is possible where the telescoping ends overlap, even in the case of a club in which the outer shaft part flares outwardly from the end which overlaps with the inner shaft part.

The locking mechanism includes an expander which can be withdrawn into the split end to cause it to become splayed, to engage the internal surface of the other of the internal tube and the inner shaft part. Preferably, it is the end of the internal tube that is split and is received in the end of the inner shaft part so that the end engages the internal surface of the inner shaft part when the expander is withdrawn into the end of the internal tube to engage the internal surface of the inner shaft part.

Preferably, the club includes an internal tube which is fastened within the outer shaft part and extends along the inside of the outer shaft part. The internal tube can have a split end which is received within the inner shaft part in a telescoping arrangement, in which the internal tube provides the inner tube part of the locking mechanism, and the inner shaft part provides the outer tube part of the locking mechanism. In another arrangement, the inner shaft part has a split end which is received within the internal tube in a telescoping arrangement, in which the internal tube provides the outer tube part of the locking mechanism, and the inner shaft part provides the inner tube part of the locking mechanism.

Preferably, the internal tube has a substantially constant cross-section along at least that part of its length which is expected to overlap with the inner shaft part when the club is assembled, especially when the end of the inner shaft part is received within the internal tube. Preferably, the inner shaft part has a substantially constant cross-section along at least that part of its length which is expected to overlap with the internal tube when the club is assembled, especially when the end of the internal tube is received within the inner shaft part. It is particularly preferred that the internal tube and the inner shaft part are selected so that they are a sliding telescoping fit with a small clearance between them. For example, when the tubes have a circular cross-section, the difference between the internal diameter of the outer tube and the external diameter of the inner tube is preferably not more than about 1 mm, for example about 0.5 mm.

Preferably, the locking mechanism includes a control member for the expander, for controlling the position of the expander relative to the said split end. Preferably, the locking mechanism is arranged so that it is operated from about the end of the outer shaft part remote from the inner shaft part. Generally, the club will have a grip at this end and access to the locking mechanism can be gained through a hole in the grip, for example in the end of the shaft or in its side wall.

Operation of the locking mechanism at the end of the outer shaft part remote from the inner shaft part has the advantage that it raises the center of gravity of the club. This can provide benefits in terms of the feel of the club when in use.

Preferably, the club includes a separate tool for operating the locking mechanism. The nature of the tool will depend on the locking mechanism. For example, when the locking mechanism includes a threaded component, the tool will have an appropriate configuration to engage the head of the threaded component, such as a hexagonal head (an Allen key), or a flat or cross-head screw driver. Such tools can be designed to be inserted through a small hole in the golf club grip. The use of a separate tool for the locking mechanism has the advantage that a club can be arranged with a desired configuration and locked in that configuration, making it difficult for a user to change the configuration without the tool. This can be important having regard to certain rules which might be invoked concerning adapting a club during a game of golf.

The locking mechanism should be arranged so that the stress on the expander control member when the locking mechanism is in its locking position is at least about 100 $MN \cdot m^{-2}$, preferably at least about 125 $MN \cdot m^{-2}$, for example about 150 $MN \cdot m^{-2}$. Preferably, the locking mechanism includes a resiliently deformable spring element which is deformed when the locking mechanism is in its locking position to place the expander control member under load. Preferably, the club includes a tension adjuster for setting the expander control member stress when the locking mechanism is in its locking position. For example, the tension adjuster can be used to adjust the effective length of the expander control member. This can be achieved for example by means of a threaded bolt which can be screwed into a head block at the end of the control member Preferably, the locking mechanism includes a movable member connected to the expander control member, and a stop which restricts movement of the movable member from the locked position towards the unlocked position to movement in a single unlocking direction, the golf club shaft including a component which is resiliently deformable and which biasses the movable member while in the locking position towards the stop. The resiliently deformable member can be a spring element as discussed above. In other constructions, the control member can be formed from a material which allows it to be resiliently deformed.

The resiliently deformable component which biases the movable member towards the locking position can be the expander control member.

The movable member of the locking mechanism can comprise an eccentric shaft which is mounted for rotation within a bore in the head of the expander control member. The shaft can be rotated by means of a separate tool, which is inserted along the axis of the shaft. Preferably, the axis of rotation of the eccentric shaft is approximately perpendicular to the axis of the golf club shaft. The camming surface of the shaft is preferably provided by a larger diameter, substantially cylindrical portion which is eccentrically mounted. The amount of movement of the control member is determined by the degree of eccentricity of the shaft. Preferably, the shaft provides for displacement of the end of the control member by at least about 0.5 mm, more preferably at least about 1.0 mm. The displacement of the end of the shaft will generally be not more than about 3.0 mm, preferably not more than about 2.0 mm. The amount of the displacement of the end of the control member should preferably be sufficient to withdraw the expander into the inner tube to cause its end to become splayed, for the tension applied to the control member to be sufficient for the inner and outer tubes to engage one another sufficiently securely for them to be unable to move relative to one another during normal use.

When the movable member of the locking mechanism comprises an eccentric shaft, the stop can be arranged so as to stop movement of the shaft just after it has passed through the top center position in which the expander is withdrawn into the end of the inner tube to the maximum extent. The stop can act directly on the eccentric shaft or indirectly, for example through the head of the expander control member. When the resiliently deformable member is provided by the control member, it is deformed to the maximum extent when the eccentric shaft is in this position, and then relaxes when the stop prevents further movement of the movable member. Releasing the locking mechanism therefore requires further deformation of the control member as the eccentric shaft is moved through the top center position.

Accordingly, in another aspect, the invention provides a golf club which includes an adjustable shaft, in which the shaft comprises:

a. inner and outer tubes which are fitted together in a telescoping arrangement, the telescoping end of the inner tube being split so that it can be splayed, b. a expander which can be withdrawn into the end of the inner tube to cause the end to become splayed to engage the internal surface of the outer tube, c. a control member for the expander which extends within the inner tube and can control the position of the expander relative to the split end of the inner tube, and d. a locking mechanism by which the expander control member can be moved between a locked position in which the expander is withdrawn into the end of the inner tube to cause its end to become splayed, and an unlocked position in which the expander is not located tightly within the splayed end of the inner tube allowing the splayed end to relax from engaging the outer tube, the locking mechanism including a movable member connected to the expander control member, and a stop which restricts movement of the movable member from the locked position towards the unlocked position to movement in a single unlocking direction, the golf club shaft including a component which is resiliently deformable and which biasses the movable member while in the locking position towards the stop.

The use of a resiliently deformable component to bias the movable member of the locking mechanism towards the stop has the advantage of providing control over the force for operating the locking mechanism. This can mean that the force which is exerted on the expander to cause the inner tube to splay can be controlled so that it is not dependent on the force which is applied by the user to the locking mechanism.

The resiliently deformable member can comprise a spring. A preferred form of spring comprises a series of dome washer springs, such as are available from Schnorr. When the member is a separate spring, the strain imparted to the spring is preferably greater when the control member is in its unlocked position than when it is in the locked position. A spring can be arranged to exert a predetermined stress on the expander through the control member by acting between the control member and a mounting stop in the inner tube. The stress can be predetermined by appropriate selection of the springs and of the control member. The club can include means for adjusting the effective length of the expander control member, for example by fitting a threaded fastener into the end of the control member. It is possible in this way to ensure that the fixation force of the inner and outer tubes is sufficient to prevent unwanted movement during use of the club. When it is desired to loosen the inner and outer tubes, for example to change the length of the club or to change the angular alignment of the grip and head, the tension on the expander control member is released by increasing the stress on the spring. This can be achieved by applying a force to the head of the control member in a direction which is opposite to the direction in which the spring acts, for example using a threaded adjuster and appropriate tool. Preferably, it can be preferred for the movable member to be threaded, and to be moved between the locked and unlocked positions by rotation. Preferably, the axis of rotation of the movable member is approximately parallel to the axis of the golf club shaft.

The inner and outer tubes can be lower and upper shaft parts respectively. In this arrangement, the expander control member will extend downwardly within the lower shaft part for adjustment from the bottom end of the shaft. It can be adjusted at the bottom end if the control member extends to the bottom end. Alternatively, if the control member is relatively short, it can be adjusted within the shaft by use of an appropriately long tool which can be inserted from the bottom end of the shaft.

The inner tube can be an internal tube within an outer shaft part, whose split end engages the internal surface of an inner shaft part which provides the outer tube, generally as discussed above in relation to the first aspect of the present invention.

The material of the shaft parts can be as used conventionally in club manufacture. The material of the expander will be selected so that it can withstand the splaying forces applied to the split tube. The expander control member will generally be in the form of a rod. The material of the rod will depend on the properties required of it. For example, when the control rod is required to be extensible, a suitable material might be steel with an elastic modulus of about $2\times10^5$ $MN\cdot m^{-2}$ and an ultimate tensile strength of 100 $MN\cdot m^{-2}$.

BRIEF DESCRIPTION OF THE DRAWINGS

Embodiments of the present invention will now be described by way of example with reference to the accompanying drawings, in which.

DETAILED DESCRIPTION OF THE INVENTION

Figures 1, 1A, 1B:
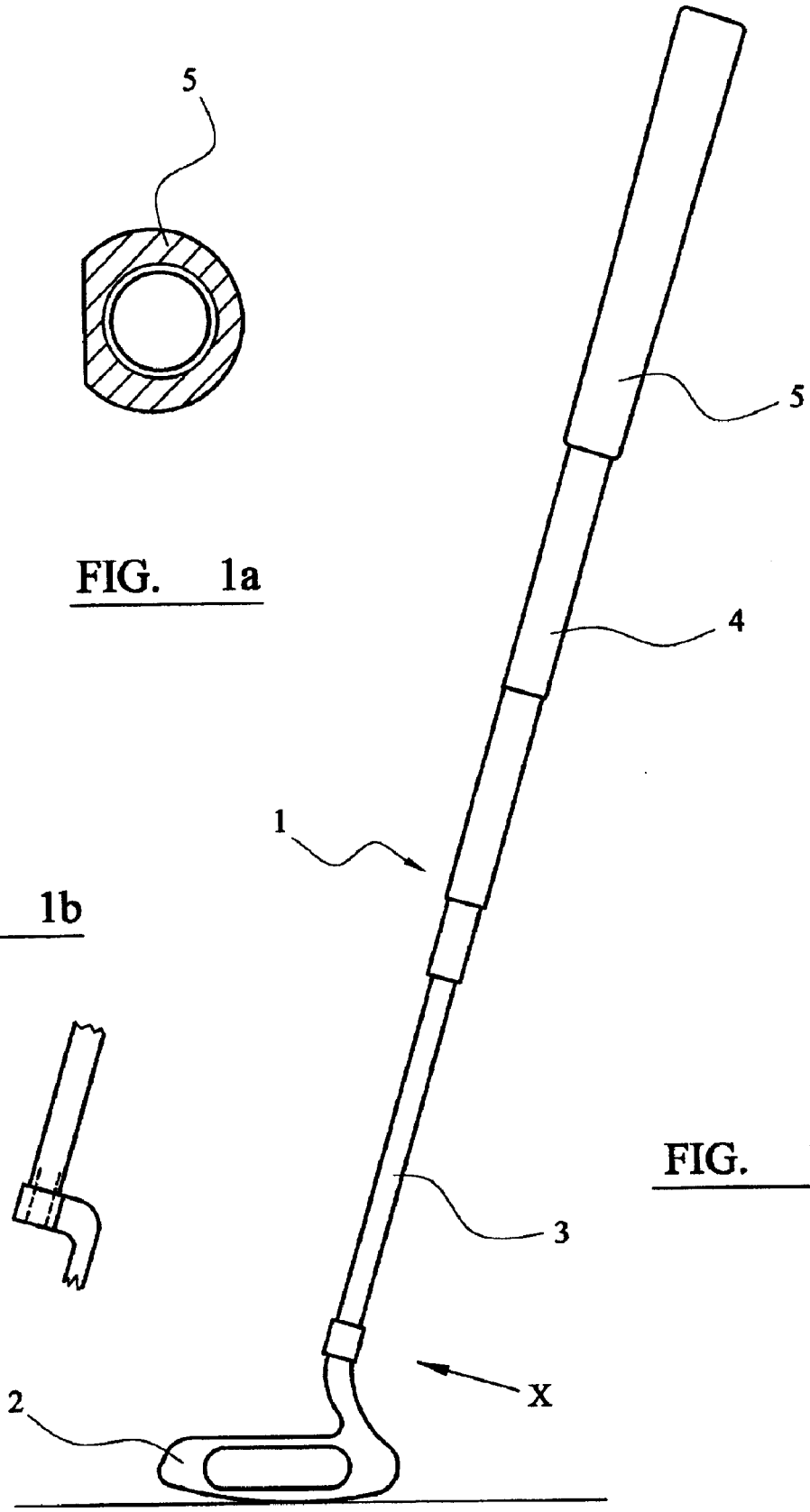
FIG. 1 is a schematic representation of an adjustable putter according to the present invention.
FIG. 1*a* shows a typical section through the putter grip.
FIG. 1*b* shows a part view of the putter to shaft connection in direction of arrow x.

Referring to the drawings, FIG. 1 shows a putter 1 which comprises a golf club head 2 connected to a lower shaft part 3. The putter is shown having a shaft length set in mid position. The putter grip 5 is connected to the upper shaft part 4.

FIG. 1*a* shows an enlarged section through a typical profiled grip 5 which is fixed to the upper shaft part 4. The grip profile can take one of several forms and is designed to locate the hands when putting and so aid repeatability and consistency when gripping the club. The adjustable shaft not only allows adjustment for length but also for angular alignment of grip to putter striking face.

FIG. 1*b* shows a typical connection between the shaft and putter head. The offset of the connection allows access for tool insertion where required.

The sectional drawing (FIG. 2) shows a shaft locking mechanism. The mechanism comprises an internal locking tube 8, which is permanently fixed at its screw adjuster end to the inside of the upper shaft part 4. The outside of the remote end of the locking tube 8 is slideably mounted to the inside of lower shaft part 3 so that the lower shaft part 3 can slide between the upper shaft part 4 and the locking tube 8.

The free end of the locking tube 8 which slideably connects to the lower shaft part 3 has a conical bore which mates with a conical expander 20. The expander is connected to a control rod 22 which extends within the locking tube 8. The conical bore end of locking tube 8 is axially slit in four places to form a collet. The control rod 22 has a bolt 24 screwed into it at the end remote from the expander 20. Springs 7 act between a stop 26 on the locking tube 8 and the head of the bolt 24, to force the expander into the end of the locking tube 8. The spring force is of sufficient magnitude to provide a sufficiently tight connection between the locking tube 8 and lower golf shaft 3, which is capable of withstanding disturbing forces significantly greater than those induced during normal golf play. The force provided by the spring 7 removes any influence of the player on locking forces.

The springs 7 are factory pre-loaded to provide the required force for locking. To release the spring force and allow adjustments to be carried out a captive socket head capscrew 6 is provided such that clockwise rotation of the screw (for example using a tool such as an Allen key) compresses the springs 7 and releases the locking grip. Anticlockwise rotation of the screw releases the springs and hence applies the locking grip.

The Allen key is inserted through a hole 9 in the top of the club grip 5.

Figure 2:
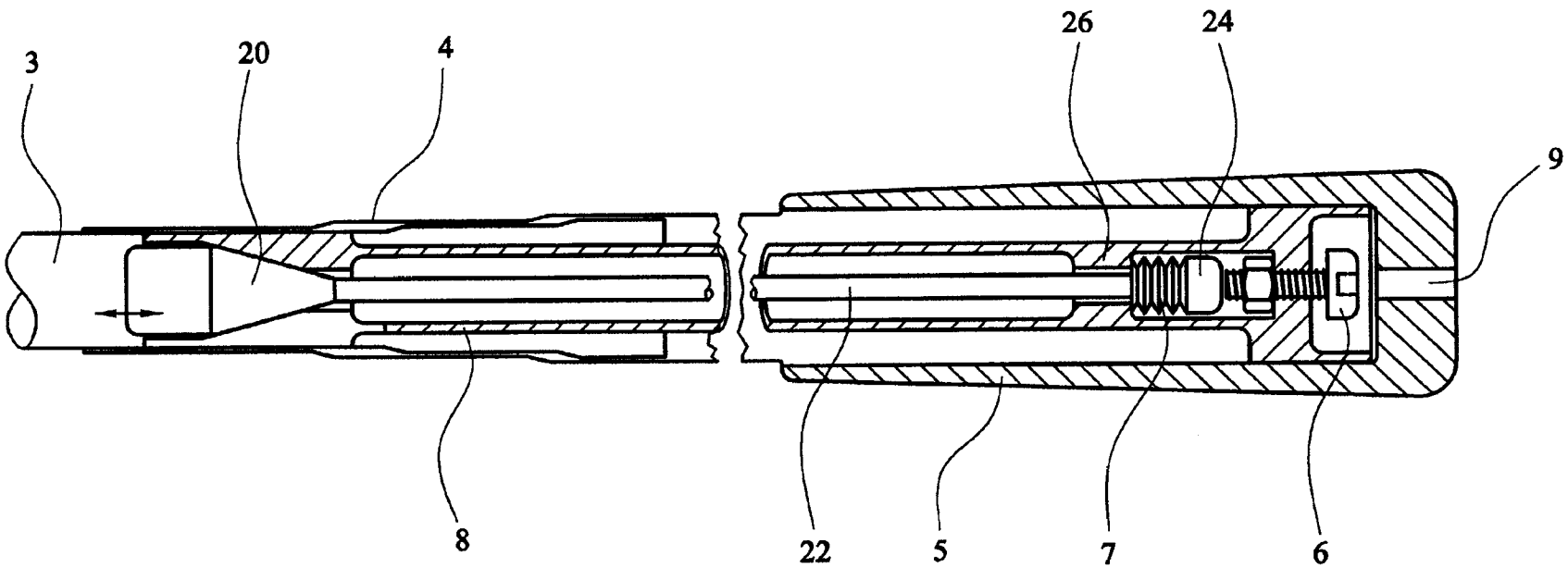
FIG. 2 shows a schematic sectional arrangement of a locking mechanism for a telescopic shaft.
Figure 3:
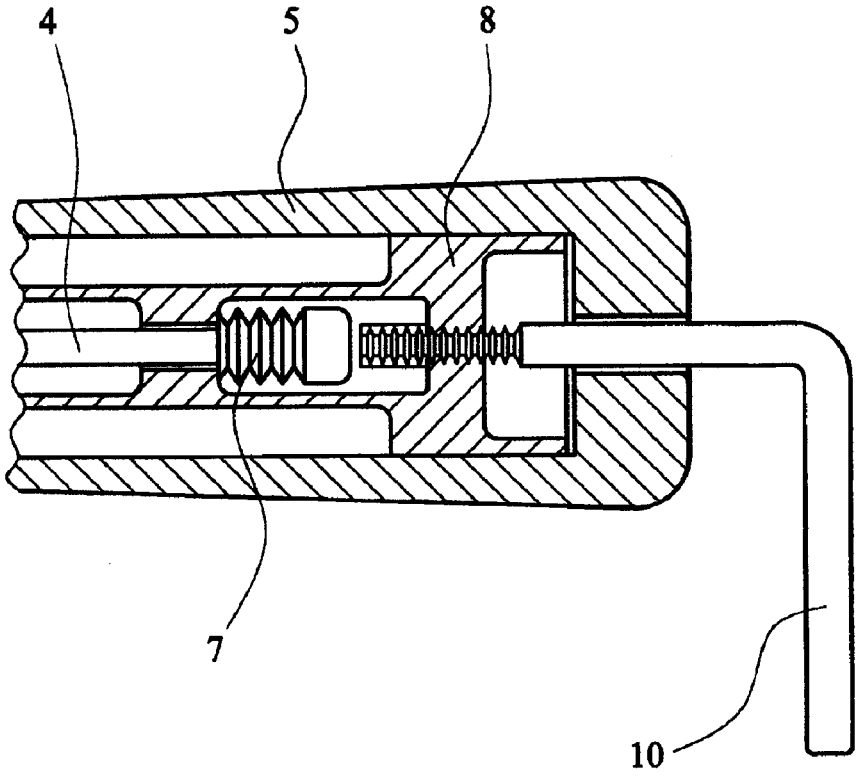
FIGS. 3 and 4 are schematic representations of further embodiments of a locking device.

FIG. 3 shows a further option for locking and unlocking the spring loaded assembly shown in FIG. 2. By replacing locking head capscrew 6 and nut with removable screwed key 10 the disc springs 7 cannot be left, after adjustment, in a part loaded state as can happen with the capscrew 6 method. That is, the screwed key 10 has to be removed after adjustment before the club is useable and is guaranteed therefore to be fully locked.

Figure 4:
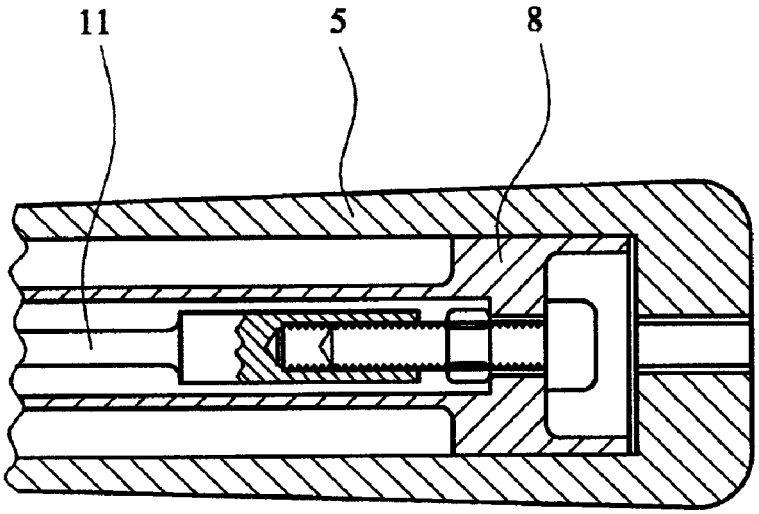

FIG. 4 shows a further option for providing the forces to the locking device by replacing the spring-loaded rod 4 (FIG. 2) with a similar rod 11, but with means provided at its remote end for the load to be applied through its interface with socket head capscrew 12 which is held captive in locking tube 8.

Figure 5:
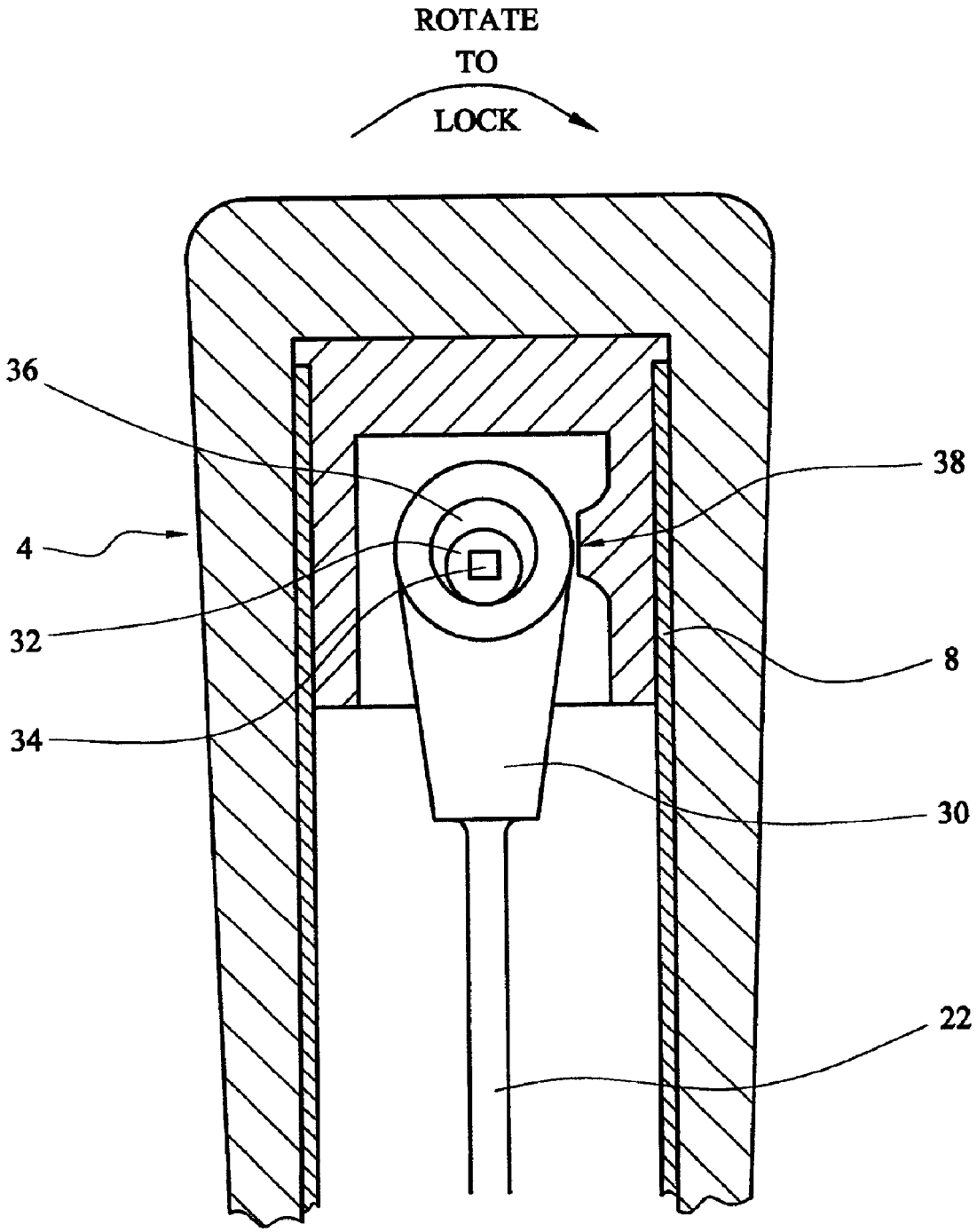
FIG. 5 is a sectional elevation through an alternative construction of locking mechanism.

FIG. 5 shows an alternative construction of club shaft in which the control rod 22 has a head 30 fitted to it with a transverse bore extending through it. An eccentric shaft 32 is fitted in the head of the upper shaft part 4 and the locking tube 8. The shaft has a bore 34 in it for receiving a tool by which the shaft can be rotated. The shaft has an eccentric portion 36 of larger diameter, corresponding approximately to the internal diameter of the bore in the head 30 of the control rod 22. By virtue of the action of the eccentric portion 36 of the shaft on the control rod, rotation of the shaft using a tool in the shaft bore 34 causes the control rod, and therefore the expander, to be moved axially within the locking tube 8.

The locking tube 8 has a locking stop 38 formed in its internal wall. The locking stop prevents rotation of the eccentric shaft 32 significantly beyond top dead center. As the eccentric shaft is rotated to the top dead center position, the control rod 22 is moved up within the locking tube, withdrawing the expander into the end of the tube to cause it to splay. The control rod is stressed by rotation of the shaft, and the load on the rod is relaxed slightly as the eccentric shaft is moved beyond top dead center, until the control rod head contacts the locking stop 38 in the internal wall of the locking tube. Releasing the expander from within the locking tube involves rotating the eccentric shaft in the opposite direction, initially involving applying further stress to the control rod as the eccentric shaft is rotated to the top dead center position.

Figure 6:
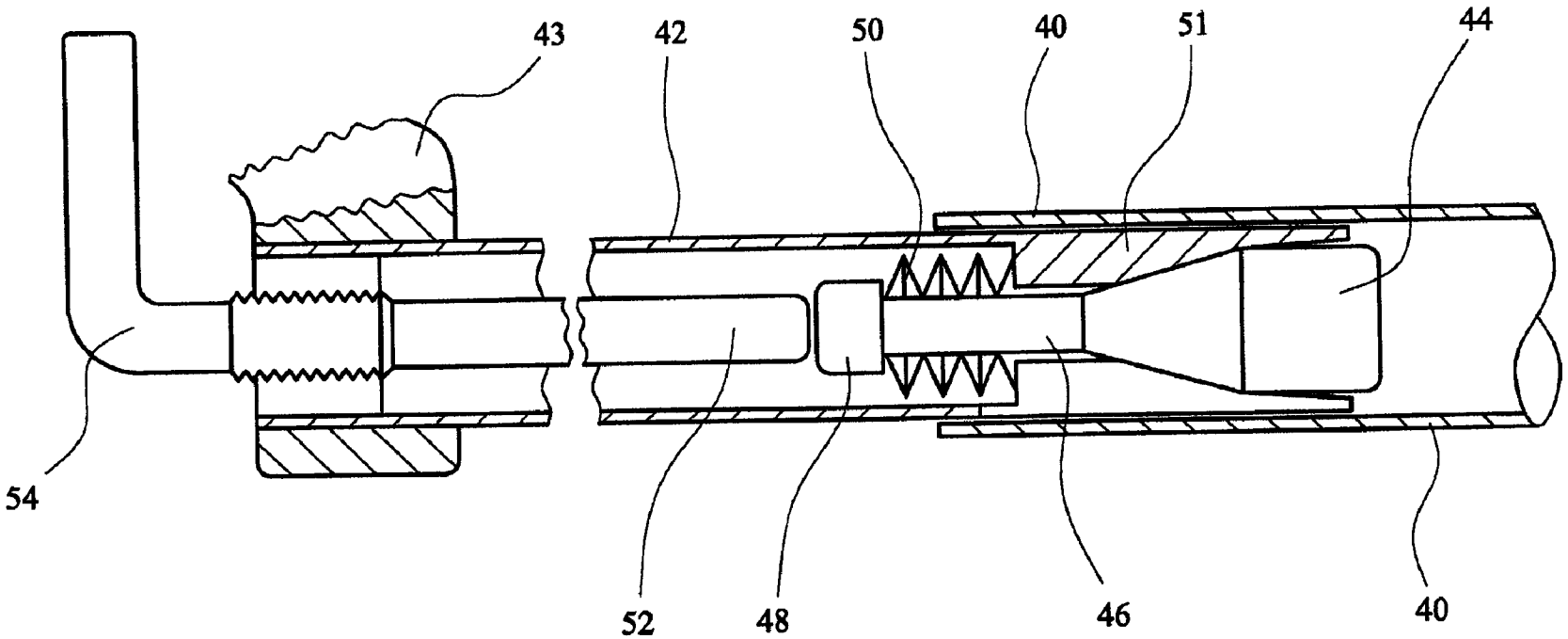
FIG. 6 is a sectional elevation through another construction of a club shaft.

FIG. 6 shows a further construction of club shaft which comprises upper and lower shaft parts 40, 42. The club head 43 is mounted on the lower shaft part at its lower end, and the lower shaft part 42 is split at its upper end so that it can receive an expander 44 of a similar shape to the expander shown in FIG. 2. The expander control rod 46 extends downwardly and terminates in a bolt 48. Springs 50 act between the head of the bolt 48 and a stop 51 on the inside of the lower shaft part 42. The springs act to withdraw the expander into the split upper end of the lower shaft part to cause it to splay and to engage the internal wall of the upper shaft part. The expander can be released from within the end of the lower shaft part by applying force upwardly on the head of the bolt 48, using a threaded driver 52 and an appropriate tool 54. The driver and tool can be provided as separate components or as a single component.

Figure 7:
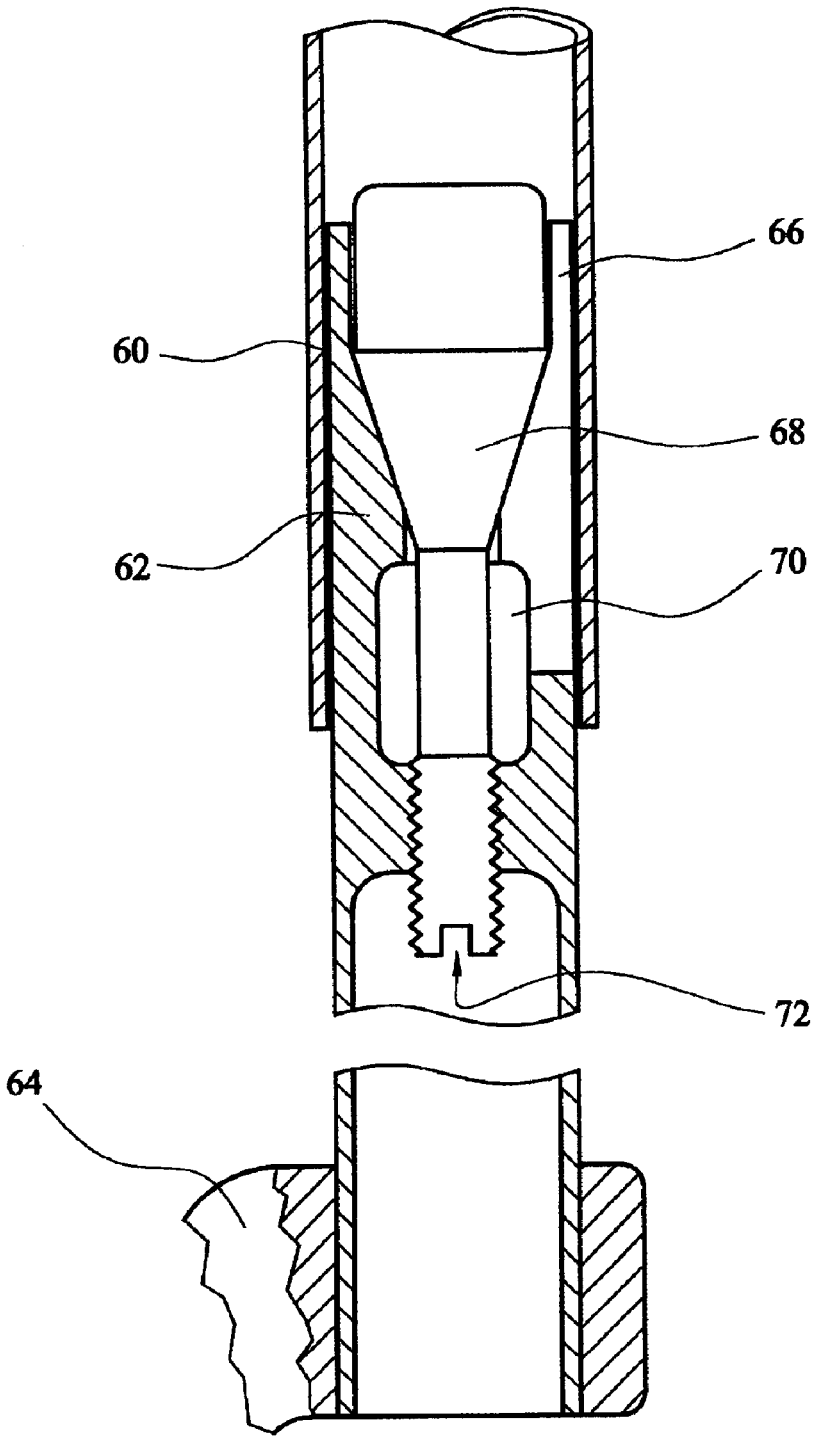
FIG. 7 is a sectional elevation through a further construction of locking mechanism.

FIG. 7 shows a construction of golf club which includes an outer shaft part 60 and an inner shaft part 62. The club head 64 is fastened to the inner shaft part. The inner shaft part is split at its upper end 66. It includes a tapered expander 68 which is formed as one piece with a threaded rod 68. The rod extends through a nut 70 which has a threaded bore extending through it. The rod as a slot 72 at its end remote from the outer shaft part and the inner shaft part is open (or can be opened) at the end on which the club head is fastened so that a screwdriver can be inserted into the inner shaft part with the head of the screwdriver located in the slot 72 in the rod, to cause the expander to rotate. Rotation of the expander causes it to move axially relative to the inner shaft part. Drawing the expander into the inner shaft part causes it to expand at its upper end, so that the inner and outer shaft parts engage one another. Releasing the expander from within the inner shaft part allows the inner shaft part to contract at its upper end so that the inner shaft part can be released from the outer shaft part.

Figure 8:
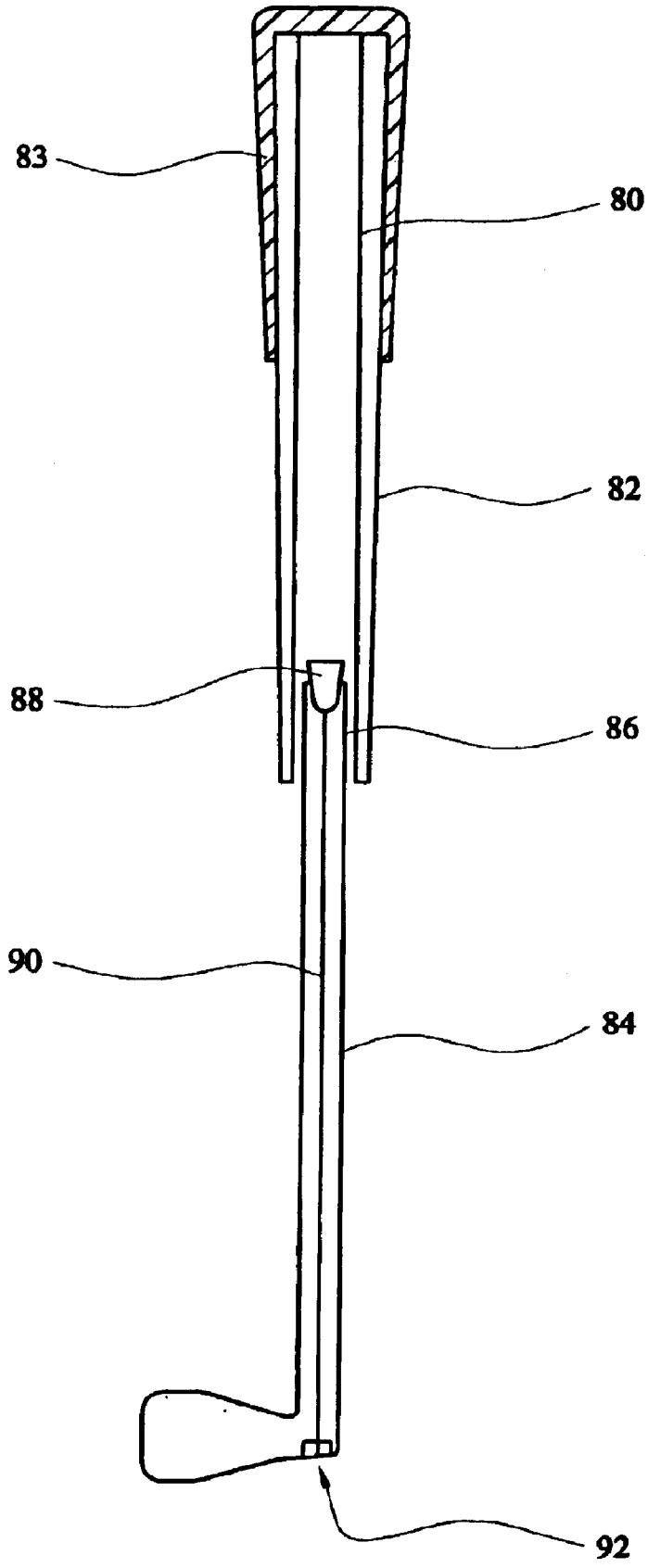
FIG. 8 is a sectional elevation through another embodiment of golf club according to the present invention.

FIG. 8 shows a shaft locking mechanism which represents a variant on the mechanism shown in FIG. 2. The mechanism comprises an internal locking tube 80, which is permanently fixed at its upper end to the inside of the upper shaft part 82. the upper shaft part has an external rubber grip 83. The lower end of the locking tube 80 slideably receives the upper end of a lower shaft part 84 within it so that the lower shaft part 84 can slide within the locking tube.

The lower shaft part 84 is axially slit at its upper end 86. The lower shaft part has a conical expander 88 mounted within it. The expander is connected to a control rod 90 which extends within the lower shaft part 84. The control rod can be controlled from the lower end of the lower shaft part using a mechanism 92, for example generally of the type which is provided at the upper end of the upper shaft part in the embodiment which is shown in FIG. 2 to control the expander in that embodiment.

What is claimed is:

1. A golf club which includes an adjustable shaft, in which the shaft comprises:

a. an inner shaft part, b. an outer shaft part which has an open end in which an end-of the inner shaft part can be received, the outer shaft part flaring outwardly from its open end-and having an internal tube fastened within it which extends along the inside of the outer shaft part, which can engage the inner shaft part in a telescoping arrangement, and c. a locking mechanism by which the inner and outer shaft parts can be locked together against relative axial and rotational movement, in which the locking mechanism comprises an inner tube part having a split end provided by one of the inner shaft part and the internal tube, and an outer tube part provided by other of the inner shaft part and the internal tube which can receive the split end of the inner tube part in a telescoping arrangement, and an expander which can be drawn into the split end of the inner tube part to cause it to become splayed, to engage the internal surface of the outer tube part.

2. A golf club as claimed in claim 1, in which the internal tube has a split end which is received within the inner shaft part in a telescoping arrangement, in which the internal tube provides the inner tube part of the locking mechanism, and the inner shaft part provides the outer tube part of the locking mechanism.

3. A golf club as claimed in claim 1, in which the inner shaft part has a split end which is received within the internal tube in a telescoping arrangement, in which the internal tube provides the outer tube part of the locking mechanism, and the inner shaft part provides the inner tube part of the locking mechanism.

4. A golf club as claimed in claim 1, in which the locking mechanism includes a control member for the expander, for controlling the position of the expander relative to the said split end.

5. A golf club as claimed in claim 4, in which the expander control member can be moved between a locked position in which the expander is drawn into the end of the inner tube part to cause its end to become splayed, and an unlocked position in which the expander is not located tightly within the splayed end of the inner tube part allowing the splayed end to relax from engaging the outer tube part.

6. A golf club as claimed in claim 5, in which the expander control member is biassed towards the locked position by a deformable component acting against a stop.

7. A golf club as claimed in claim 6, which includes a movable member which is connected to the expander control member, in which the stop restricts movement of the movable member from the locked position towards the unlocked position to movement in a single unlocking direction, the movable member being biassed towards the stop when the expander control member is in the locked position.

8. A golf club as claimed in claim 4, in which the locking mechanism includes a resiliently deformable spring element which is deformed when the locking mechanism is in its locking position to place the expander control member under load.

9. A golf club as claimed in claim 8, in which moving the expander control member from the locked position towards the unlocked position involves increasing the strain imparted to the spring.

10. A golf club as claimed in claim 4, which includes a tension adjuster for setting the expander control member stress when the locking mechanism is in its locking position.

11. A golf club as claimed in claim 4, in which the locking mechanism is arranged so that the stress on the expander control member when the locking mechanism is in its locking position is at least about 100 $MN \cdot m^{-2}$.

12. A golf club as claimed in claim 1, in which the locking mechanism can be operated from outside the outer shaft part.

13. A golf club as claimed in claim 1, in which the locking mechanism is arranged so that it is operated from about the end of the outer shaft part remote from the inner shaft part.

14. A golf club as claimed in claim 1, which includes a separate tool for operating the locking mechanism.

15. A golf club as claimed in claim 1, in which the end of the inner shaft part is splayed so that the inner shaft part provides the inner tube part of the locking mechanism, being received in the end of the internal tube which provides the outer tube part of the locking mechanism and expanded by withdrawal of the expander.

16. A golf club as claimed in claim 15, in which the locking mechanism includes a control member for the expander, for controlling the position of the expander relative to the split end of the inner shaft part.

17. A golf club as claimed in claim 16, in which the expander control member can be moved between a locked position in which the expander is withdrawn into the end of the inner shaft part to cause its end to become splayed, and an unlocked position in which the expander is not located tightly within the splayed end of the inner shaft allowing the splayed end to relax from engaging the outer shaft part.

18. A golf club as claimed in claim 17, in which the expander control member is biassed towards its locked position by a deformable component acting against a stop.

19. A golf club as claimed in claim 18, which includes a movable member which is connected to the expander control member, in which the stop restricts movement of the movable member from the locked position towards the unlocked position to movement in a single unlocking direction, the movable member being biassed towards the stop when the expander control member is in the locked position.

20. A golf club as claimed in claim 19, in which the resiliently deformable component which biasses the movable member towards the locking position is the expander control member.

21. A golf club as claimed in claim 19, in which the movable member is threaded and is moved between the locked and unlocked positions by rotation.

22. A golf club as claimed in claim 19, in which the axis of rotation of the movable member is approximately parallel to the axis of the golf club shaft.

23. A golf club as claimed in claim 17, in which the locking mechanism includes a resiliently deformable spring element which is deformed when the locking mechanism is in its locking position to place the expander control member under load.

24. A golf club as claimed in claim 23, in which moving the expander control member from the locked position towards the unlocked position involves increasing the strain imparted to the spring.

25. A golf club as claimed in claim 23, which includes a tension adjuster for setting the expander control member stress when the locking mechanism is in its locking position.

26. A golf club as claimed in claim 15, in which the locking mechanism can be operated from outside the inner shaft part.

27. A golf club as claimed in claim 15, in which the locking mechanism can be operated from about the end of the inner shaft part which is remote from the outer shaft part.

28. A golf club as claimed in claim 15, which includes a separate tool for operating the locking mechanism.

29. A golf club as claimed in claim 15, which includes means for adjusting the effective length of the expander control member.

* * * * *